US010794648B2

(12) United States Patent
Henninger et al.

(10) Patent No.: US 10,794,648 B2
(45) Date of Patent: Oct. 6, 2020

(54) MAGAZINE RELEASE AND HOLDING APPARATUS FOR USE WITH FIREARMS

(71) Applicant: Heckler & Koch GmbH, Oberndorf/Neckar (DE)

(72) Inventors: Frank Henninger, Oberndorf (DE); Michael Riegler, Vienna (AT)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 16/045,387

(22) Filed: Jul. 25, 2018

(65) Prior Publication Data

US 2019/0033022 A1 Jan. 31, 2019

(30) Foreign Application Priority Data

Jul. 28, 2017 (DE) ..... 10 2017 007 199

(51) Int. Cl.
*F41A 9/59* (2006.01)
*F41A 17/38* (2006.01)
*F41A 35/06* (2006.01)

(52) U.S. Cl.
CPC ..... *F41A 9/59* (2013.01); *F41A 17/38* (2013.01); *F41A 35/06* (2013.01)

(58) Field of Classification Search
CPC .. F41A 17/38; F41A 35/06; F41A 9/59; F41C 3/00
See application file for complete search history.

(56) References Cited

U.S. PATENT DOCUMENTS 4,521,985 A 6/1985 Smith et al.
4,539,770 A 9/1985 Bornancini
(Continued)

FOREIGN PATENT DOCUMENTS

DE 10321993 A1 12/2004
DE 102012019911 4/2014
(Continued)

OTHER PUBLICATIONS

German Patent Office, "Office Action", issued in connection with German Patent Application No. 10 2017 007 199.3, dated Jun. 15, 2018, with English Translation, 24 pages.
(Continued)

*Primary Examiner* — J. Woodrow Eldred
(74) *Attorney, Agent, or Firm* — Hanley, Flight & Zimmerman, LLC

(57) ABSTRACT

Methods, apparatus, systems and articles of manufacture for magazine release and holding apparatus for use with firearms are disclosed. An example magazine release and holding apparatus for a firearm comprises a magazine release slide to transfer a magazine holding element between a holding position and a release position, an end of the magazine release slide including one or more guide elements extending perpendicular to a longitudinal direction of the magazine release slide, and an operating handle including one or more counter guide recesses sized to receive the one or more guide elements and couple the operating handle to the magazine release slide, the operating handle projecting from a side of a handle piece of the firearm, wherein the operating handle is exchangeable and mountable to the magazine release slide by coupling or decoupling the operating handle and the magazine release slide.

19 Claims, 11 Drawing Sheets

(56) References Cited

U.S. PATENT DOCUMENTS

| | | | |
|---|---|---|---|
| 4,615,134 | A | 10/1986 | Beretta |
| 4,759,144 | A | 7/1988 | Egan et al. |
| 7,958,661 | B2 | 6/2011 | Strayer |
| 8,166,691 | B1 | 5/2012 | Karfiol |
| 9,541,340 | B2 | 1/2017 | Fluhr et al. |
| 2006/0123683 | A1 | 6/2006 | Garrett et al. |
| 2010/0281736 | A1 | 11/2010 | Mayberry et al. |
| 2012/0260791 | A1 | 10/2012 | Kerbrat et al. |
| 2017/0199000 | A1* | 7/2017 | Paquette ..... F41A 35/06 |

FOREIGN PATENT DOCUMENTS

| | | |
|---|---|---|
| EP | 0364408 | 4/1990 |
| EP | 1657516 A1 | 5/2006 |
| GB | 2006404 A | 5/1979 |

OTHER PUBLICATIONS

European Patent Office, "Extended European Search Report," dated Dec. 6, 2018 in connection with European Patent Application No. 18185940.6, 8 pages (original document and machine translation).
European Patent Office, "Office Action," dated Nov. 28, 2019 in connection with European Patent Application No. 18185940.6, 8 pages (Entire document and machine translation).

* cited by examiner

MAGAZINE RELEASE AND HOLDING APPARATUS FOR USE WITH FIREARMS

FIELD OF THE DISCLOSURE

This disclosure relates generally to a magazine release and holding apparatus. This disclosure relates more particularly to a magazine release and holding apparatus for a firearm having a magazine release slide for transferring a magazine holding element from its magazine holding position to its magazine release position and vice versa, wherein at least one exchangeable operating handle projecting from one side of a handle piece/housing of the firearm is provided on the magazine release slide. In addition, this disclosure relates to a handle piece and a firearm housing of a firearm, each of which is equipped with such a magazine release and holding apparatus, as well as a magazine.

BACKGROUND

Magazine release and holding apparatuses are known in different configurations and have the objective of holding a magazine in the magazine shaft of a firearm, for example, by latching or releasing it again, for example, to change the magazine. In these documents, position designations such as "up", "down", "front", "rear", etc. always refer to a firearm held in a normal firing position, in which the bore axis extends horizontally and the shot release occurs forward, away from the shooter.

A magazine, e.g. according to NATO standard, includes a magazine catch on its left side. When a shooter has inserted such a magazine completely into the magazine shaft of a firearm, a retaining pawl of a spring-loaded magazine release and holding apparatus arranged in or on the firearm housing automatically engages into the magazine catch. The magazine is then securely locked into the firearm in its operating position. Such magazine release and holding apparatuses are used for loaded firearms, for example, rifles, assault rifles, light machine guns, submachine guns and pistols.

To release the magazine, at least one handle is usually provided on the magazine release and holding apparatus. If a shooter operates the handle, it pulls and/or pushes the retaining pawl out of the magazine catch. As a result, the magazine is released and can be removed from the firearm by the shooter or falls out of the magazine shaft when the firearm is in a normal firing position. A shooter can then insert a new magazine into the magazine shaft and the magazine locks there again with the retaining pawl.

In a NATO standard magazine, a right-hand shooter operates the magazine release and holding apparatus by using the handle, normally having the index finger of his right hand on the handle piece. Like the NATO standard magazine, other magazine release and holding apparatuses can only be operated on the right side of a firearm when viewed in the firing direction, making it difficult for left-hand shooters to operate the magazine release and holding apparatus.

In the meantime, magazine release and holding apparatuses that can be operated from both sides have come to be known. These often have elaborate configurations and are mounted on the firearm or the magazine holder, protrude from a firearm and are not sufficiently secured against unintentional operation. Therefore, such known solutions often have a bulky construction and are susceptible to damage or failure of their parts in rough maneuvering or even combat operations, for example, due to contamination.

U.S. Pat. No. 4,615,134 discloses a magazine release and holding apparatus, which provides for operating purposes a push button on one side and a swivel lever on the opposite side. The handle is coupled via a pin to an elastically mounted bolt, which penetrates the magazine holding arm. When actuated, the handle is supported on the firearm housing and pulls the bolt, and thus the magazine holding arm, via the coupling and against a spring force out of the firearm housing into the magazine release position.

U.S. Pat. No. 4,521,985 has a magazine release and holding apparatus for a pistol, which can be operated from both sides and for which push buttons are provided on both sides.

U.S. Pat. No. 4,759,144 shows a magazine release and holding apparatus, which can be operated from both sides. For this purpose, a push button is provided on one side and a swivel lever on the opposite side. The swivel lever can be swiveled in a flexibly mounted cylinder and is supported on a piston-shaped part, which is fixed to the housing. When swiveling, the swivel lever pushes the cylinder against a spring into the magazine release position.

US 2010/0281736 A1 shows a magazine release and holding apparatus, which can be pivoted about a bolt as a pivot axis. The L-shaped magazine release and holding apparatus, configured in the form of a swivel lever, is actuated by a linear slide, which can be operated from both sides and which swivels the magazine release and holding apparatus out of engagement with the magazine when it is moved to the left or to the right via a control cam located in a recess in the slide.

In addition, US 2006/0123683 A1 shows another magazine release and holding apparatus, which can be operated from both sides and the magazine holding arm of which is pivoted on an actuating bolt under spring tension. The magazine release and holding apparatus can be brought out of engagement with the magazine both on the right side by pressing the actuating bolt and on the left side by swiveling the handle. In addition to these well-known double-sided magazine release and holding apparatuses, magazine release and holding apparatuses are also known that include a slide or trigger that can be used either on the left or right side as, for example, in the Colt model of 1911. The magazine holder can be integrated in the slide.

Replaceable push buttons with different heights are also known, forming attachments for the magazine release slide, but they are fastened to the slide by means of screws. For example, with the Century Arms Canik TP9 pistol, the slide can be fixed in the handle piece by means of a spring, the same as with the well-known FN Five Seven. The Century Arms Canik TP9 magazine holder is complex to handle, especially during assembly and disassembly, because the push button can only be removed from the slide by loosening a screw, exchanged for a push button of a different height and screwed back on again.

DETAILED DESCRIPTION

Figure 1A:
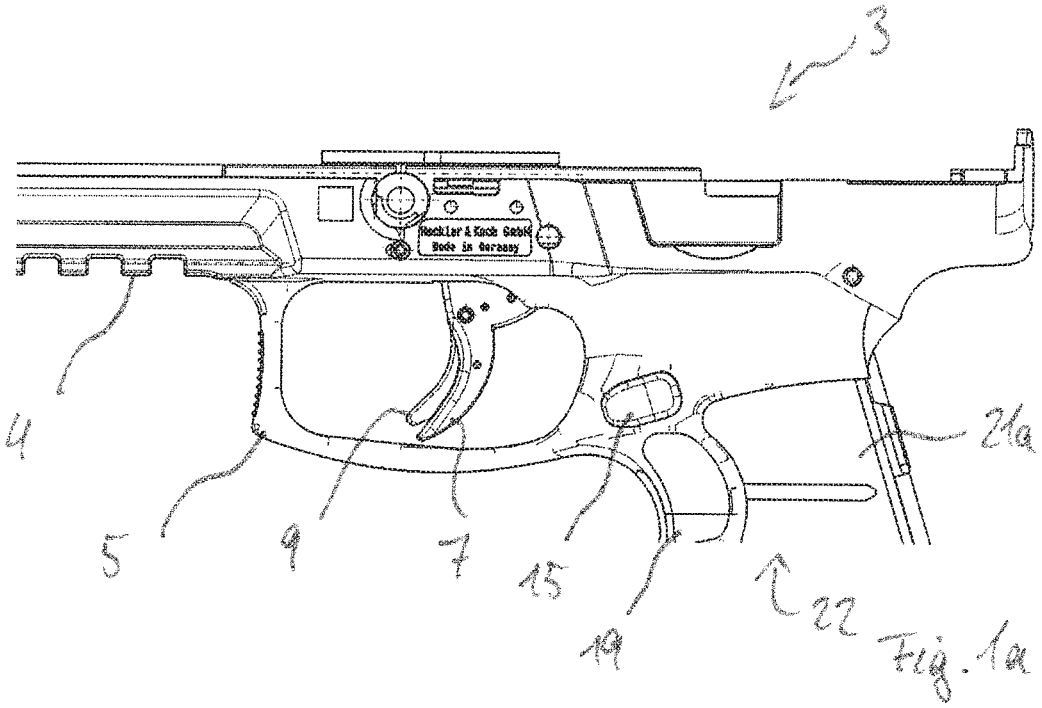
FIG. 1*a* is a partially cut-out lateral view of the left side of an example handle piece of a self-loading firearm with an example magazine release and holding apparatus.

Against this background, it is the objective of this disclosure to provide an alternative, constructively simple and functionally reliable magazine release and holding apparatus for firearms.

This problem is solved by the subject matters of the independent claims 1, 13 and 18 and 19, respectively. The generic magazine release and holding apparatus thus has the following additional characteristics: the at least one operating handle can be exchanged and mounted on the magazine release slide without tools.

The handle piece and the firearm housing of a firearm are characterized by the fact that each is equipped with such a magazine release and holding apparatus. The magazine of the firearm is characterized in that it comprises, in particular at its front side, a stop for engaging with a magazine release and holding apparatus, in particular its holding element.

Since, based on this disclosure, the operating handle, in particular a push button, can be exchanged without tools, a shooter can adapt his firearm with simple means to his ergonomic characteristics. In particular, due to the different hand sizes of shooters, it is not possible to easily reach the magazine release slide or its push button with a standard configuration of the magazine release and holding apparatus. To operate said magazine release and holding apparatuses, the shooter's shooting hand often has to leave the shooting position or even encompass it. For example, the interchangeable operating handles or push buttons can be varied in height and/or width, so that they can be quickly adapted to the ergonomic characteristics of the respective shooter.

Since the magazine release slide does not have to be replaced completely, but only its operating handle or push button, this disclosure provides a cost-effective magazine release and holding apparatus that can be used variably.

The magazine release slide extends transverse the shooting direction and can be operated via the operating handle. A shooter can transfer the magazine release slide from the magazine holding position to the magazine release position in which the magazine holding element releases the magazine by pressing the operating handle or push button. For example, the magazine holding element can engage in a recess in the magazine or alternatively comprise a counter-stop surface that engages with a catch or projection or stop on the magazine, thus preventing that the magazine holding element is released from the magazine holding position downwards out of a firearm.

The operating handle can be provided on one side of the magazine release slide or alternatively on both sides. Thus, a flexible magazine release and holding apparatus can be provided with simple means.

Advantageously, the individual operating handles or push buttons can be supplied in different lengths and geometries with a pistol set or can also be retrofitted as accessories. The inventive magazine release and holding apparatus is functionally reliable and thus increases the reliability of a firearm equipped with it. The individual parts of the magazine release and holding apparatus can be produced cost-effectively using known metal casting processes or metal powder injection molding processes, so-called MIM processes (Metal Injection Molding), but also, for example, using conventional sintering processes.

The firearm housing or housing or handle piece in terms of the present disclosure comprises a one-piece firearm housing or handle piece, as well as a multi-part firearm housing, which consists, for example, of an upper part and a lower part of the housing. The magazine release and holding apparatus is provided there at an appropriate position. The lower part of the housing can be configured in the form of a handle module, a handle module with a magazine shaft for receiving a magazine, a handle module with a magazine shaft and a receptacle for a trigger device, a handle module with a receptacle for a trigger device and a shoulder rest or a handle module with a magazine shaft, a receptacle for a trigger device and a shoulder rest. The handle piece in terms of this disclosure refers to a handle piece of firearms.

The operating handle can be attached to the magazine release slide without tools using any suitable means, for example, it can be manually screwed on a thread provided at its outer end. Preferably, the magazine release slide comprises at least one guide element for guiding at least one counter guide in or on the operating handle during its assembly and disassembly.

For example, the guide can involve a tongue and groove guide or a dovetail guide or any other suitable guide via which the operating handle can be pinned or pushed onto the magazine release slide. For example, the at least one operating handle or the push button can be mounted on the magazine release slide via a plug-in or sliding connection and the shooter can thus adjust the push button height and, if necessary, width to his hand size.

Preferably, the guide is provided in perpendicular manner to the longitudinal axis of the magazine release. This measure enables safe storage of the operating handle on the magazine release slide. The operating handle can also be secured to the magazine release slide by means of a safety element, such as a pin, a spring or similar suitable means.

Preferably, in assembled condition, the operating handle can be secured by the handle piece/housing against disassembly. Since the operating handle protrudes only partially from the housing or handle piece, the recess provided in the handle piece or housing, which at least partially receives or encompasses the operating handle, prevents it from being disassembled and then acts as a loss protection. This measure avoids the need for an additional safety device.

Preferably, the magazine release slide can be mounted optionally for left- or right-side arrangement and operation of the operating handle. For example, the magazine release slide can be rotated 180 degrees so that the operating handle can be used on the opposite side. This measure provides with simple means a versatile and flexible magazine and holding apparatus, which can be used for both left- and right-hand shooters.

Alternatively, the magazine release slide can also be operated from both sides by means of operating handles provided on both sides. Preferably, the magazine release slide has either a symmetrical or asymmetrical configuration and comprises at least one at least partially recessed connection cutout for receiving at least part of the magazine holding element in its magazine holding position.

In the case of double-sided operation, the magazine release slide has a symmetrical configuration. In the case of left- or right-side operation, it has an asymmetrical configuration. A shooter can easily see how to use the magazine release slide for right- or left-side operation.

A partially recessed connecting section in the magazine release slide allows the reception of part of the magazine holding element, which in turn secures the magazine release slide inside the housing or handle piece.

Preferably, the magazine release slide comprises at least one, in particular ramp-like or wedge-shaped actuating section, for moving the magazine holding element from its magazine holding position to its magazine release position and vice versa when the operating handle is loaded.

This measure ensures that the magazine holding element can be released with constructively simple means. For example, the ramp or wedge section can load the magazine holding element in such a way that it is pivoted and moved or swiveled from its magazine holding position to its magazine release position. In addition to the exchangeable operating handle, the ramp or wedge section is an indicator for the shooter as to how the magazine release slide is correctly mounted. The magazine holding element can form an integral part of the magazine release slide or be provided separately.

Preferably, the magazine release and holding apparatus comprises a magazine holding housing, which pivots the magazine holding element about a bearing shaft, especially between its magazine holding position and magazine release position.

Due to this separation, the magazine holding housing with its magazine holding element and the magazine release slide can be exchanged independently of each other. For example, the magazine holding element can be configured in the form of a plate-shaped holding element with a stop surface. When the ramp-like actuating section is actuated, it can act on the magazine holding element at one end so that it swivels about the bearing shaft.

The magazine holding element can be mounted in freely movable fashion in the magazine holding housing. Preferably, the magazine holding housing comprises at least one stop element to limit the movement path of the magazine holding element.

For example, the stop element can be provided in the form of a bolt, pin or beam, which extends transversely to the movement path of the magazine holding element. This measure prevents with constructively simple means that the magazine holding element is excessively used.

Preferably, the magazine holding element comprises a counter-stop surface at its end section for a stop at the magazine and/or secures with its other end section the mounted magazine release slide in the handle piece in the magazine holding position, as well as the magazine release position. For example, in this way a catch or a protrusion on the magazine can be engaged easily with the upper end of a magazine holding element, for example a retaining plate.

Advantageously, the lower end section of the magazine holding element is used for fixing and securing the magazine release slide in the firearm housing. To remove the magazine release slide, the magazine holding housing, and thus its lower end section, can be moved upwards, for example, in the handle, so that the magazine release slide is released.

For example, the magazine holding housing can be screwed into the inner wall of a handle piece or firearm housing or mounted in any other suitable way.

Preferably, the magazine holding housing comprises at least one holding section with guide sections for assembling/disassembling the magazine holding housing in the handle piece/housing, which can, for example, be inserted into counter guide sections in the housing or handle piece. The magazine holding housing can be easily moved up and down via the guide sections for assembling/disassembling the magazine release slide.

Preferably, at least one recess or counterpart is provided in the holding section, such as a retaining plate, for coupling with an elastic securing element on or in the handle piece, in particular its front inner wall, For example, the elastic safety element can be manufactured in the form of a locking spring plate, in particular made of plastic, and be provided integrally with the handle piece or housing or be fastened there. For example, the safety element can be provided in the form of a locking catch and/or stop, thus advantageously preventing unintentional removal of the magazine holding housing from the handle piece or housing.

In the magazine holding position, the magazine catch in the handle piece engages under tension in the catch recess of the magazine holding housing and thus prevents the magazine holding housing or the retaining plate from moving upwards in the magazine shaft. In this position of the magazine holding housing, the magazine holder can be operated laterally by the magazine release trigger. At the same time, the magazine holder prevents the magazine release trigger from being completely pushed out laterally.

Preferably, the magazine release and holding apparatus is held in preloaded fashion by an elastic element in its magazine holding position. For example, a spring, a rubber-like or other suitable component, such as a compression spring or spiral spring, can be provided as an elastic element. This holds the magazine release and holding apparatus flexibly preloaded in its magazine holding position.

Preferably, the handle piece comprises at least one recess on both sides for optionally receiving and assembling/disassembling the magazine release slide on the left or right side. For example, such a recess can be subsequently drilled or produced during production as a recess. Since the magazine release slide with its operating handle or push button protrudes only partially from the handle piece or firearm housing when mounted, the housing wall or wall of the handle piece also fulfils a safety function for the exchangeable operating handle, because it engages around the push button and prevents it from falling out.

Preferably, an elastic safety element is provided in or on the handle piece, in particular in the magazine shaft, in particular on its front inner side, for coupling with the counterpart and/or recess of the magazine release and holding apparatus, in particular the holding element of the magazine holding housing.

The elastic safety element can be configured integrally in the handle piece or housing or alternatively be used there. For example, the safety element can be provided in the form of a locking spring plate, which engages in particular with the recess in the retaining plate of the magazine holding housing. The safety element can also consist of a suitable material, for example plastic material.

Preferably, the safety element comprises at least one locking catch and/or at least one stop for securing the magazine release and holding apparatus, in particular the holding element in the handle piece/housing.

The locking catch can engage with the recess of the retaining plate and fix it in an intended position. Preferably, two locking catches or magazine locking catches are provided, which fix the magazine retaining plate in a first position, in which the magazine holding element fixes the magazine release slide and in a second position, in which the magazine catch or locking catch of the magazine holding housing or its retaining plate is fixed in a disassembly position. For example, the disassembly position can be moved upwards to allow the magazine release slide to be removed or mounted laterally. After releasing the magazine catch and moving the magazine holding housing in the magazine shaft, the magazine locking catches prevent the magazine holding housing with its attachments from being removed and possibly lost.

After inserting the magazine release slide, the magazine holding housing is pressed down in its guide in the magazine shaft until the second magazine catch fixed to the housing engages again in the catch recess of the magazine holding housing. In this position, the magazine retaining plate places the magazine release slide in the handle piece.

Preferably, the handle piece comprises in its magazine shaft, in particular at its inner front, at least one guide for receiving and guiding at least one complementary counter guide section of the magazine release and holding apparatus, in particular of the retaining element.

For example, the guide can be provided in the form of guide slots on both sides, so that the holding element can be simply inserted and guided from above, especially in the case of a plate-shaped configuration.

To change the magazine, a shooter moves the magazine release slide into the magazine release position, in which the magazine retaining plate is disengaged from the magazine catch or the magazine stop and thus releases the magazine.

Preferably, pressure is applied to the operating handle or push button when the shooter presses with the thumb of his respective hand on the handle. Advantageously, a right-handed and left-handed person can thus use the operating handle or push button ergonomically with his left or right hand.

The surface(s) of the operating handle, in particular of the push button, can be smooth or flat. Preferably, at least one of the operating handles, especially the push button of the magazine release and holding apparatus, has a slip-resistant operating surface.

For example, the slip-resistant operating surface can be produced by recesses, such as grooves or scoring in the surface or a rubber coating. This allows the operating handle to be operated without slipping, even with gloves and especially in a wet environment. This increases the operating safety (safety) of a firearm. Preferably, the magazine release and holding apparatus is configured in the form of a retrofit kit for firearms.

Due to the simple, compact and space-saving construction of the inventive magazine release and holding apparatus, even existing handle pieces or firearm housings can be retrofitted with said apparatus simply by exchanging parts without mechanical reworking. Firearms, such as self-loading pistols, for example, the SFP9 of the applicant, can be retrofitted with the inventive magazine release and holding apparatus. Older firearms in particular can be ergonomically optimized at low cost and retrofitted with a magazine release and holding apparatus that can be operated from both sides.

Preferably, in more modern, newly produced firearms, the inventive magazine release and holding apparatus is from the outset part of the firearm housing or the lower part of the housing or handle piece. Currently, many firearms are constructed from individual assemblies, because in this way it is easy to exchange faulty or defective parts, which applies in particular to a handle piece or firearm housing or lower part of the housing with an integrated inventive magazine release and holding apparatus.

For these reasons, the inventive magazine release and holding apparatus is also part of a firearm housing or handle piece or lower part of the housing.

The structure and function of the inventive magazine release and holding apparatus 1 is first described using FIGS. 1 to 4*b*. FIGS. 1 and 2 each show partial cut-outs of a handle piece in a lateral view from left and right with an inventive magazine release and holding apparatus 1.

The upper side of the handle piece 3 or the lower part of the handle piece 3 is configured to accommodate a barrel/tube (not shown), a closing spring (not shown) and a carriage (not shown) for the usual operation of a self-loading pistol. A Picatinny rail 4 is formed on the front underside of the handle piece 3. Toward the rear in the direction of handle piece 19 a trigger guard 5 is connected, inside which a trigger blade 7 with a trigger safety 9 is provided in well-known manner. At the rear end of the trigger guard 5, through-openings 11*a, b* are provided on both sides in the transition to handle piece 19, for using a magazine release slide 13 or trigger in a through hole 111 (see FIGS. 5 to 8). Inside the handle piece 3 there is a magazine shaft 22 into which a magazine 23 can be inserted (see FIG. 2*a, b*).

Figure 1B:
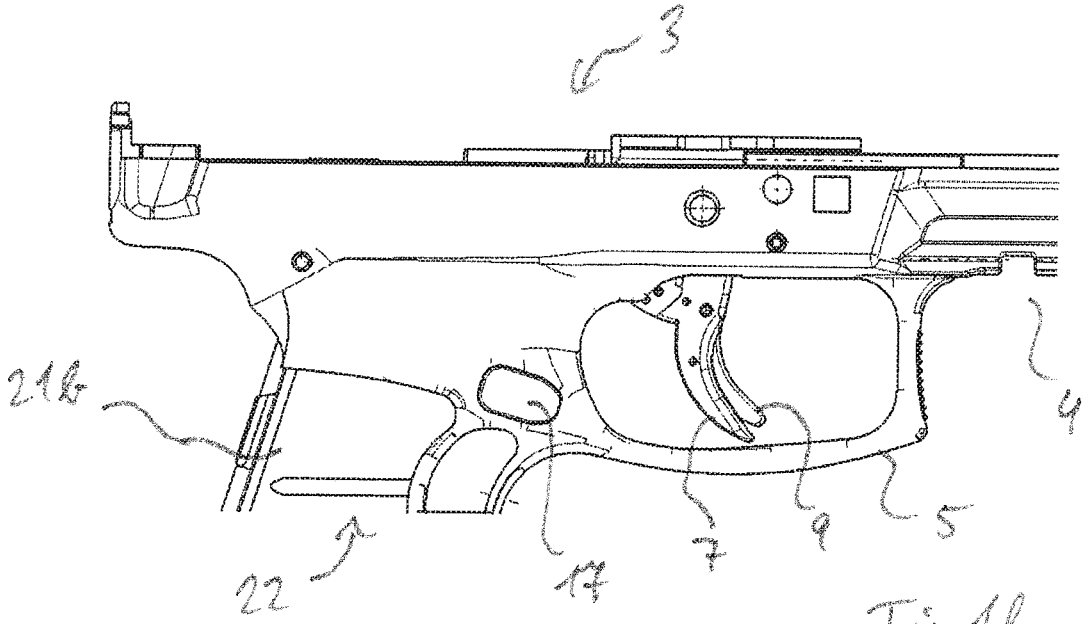
FIG. 1*b* is a partially cut-out lateral view of the right side of the handle piece of the self-loading firearm of FIG. 1*a*.

In FIG. 1*a*, the magazine release slide 13 is provided at its outer end with an exchangeable or replaceable operating handle 15 (e.g., a push button), which is provided for operating the magazine release and holding apparatus 1. On the opposite right side (FIG. 1*b*), the magazine release slide 13 comprises an integral handle 17.

The purpose of the inventive magazine releasing and holding apparatus 1 is to retain a magazine 23 inserted in magazine shaft 22 and to release it if required so that the magazine 23 can be removed downwards from magazine shaft 22 and exchanged for a new magazine 23.

Figure 2A:
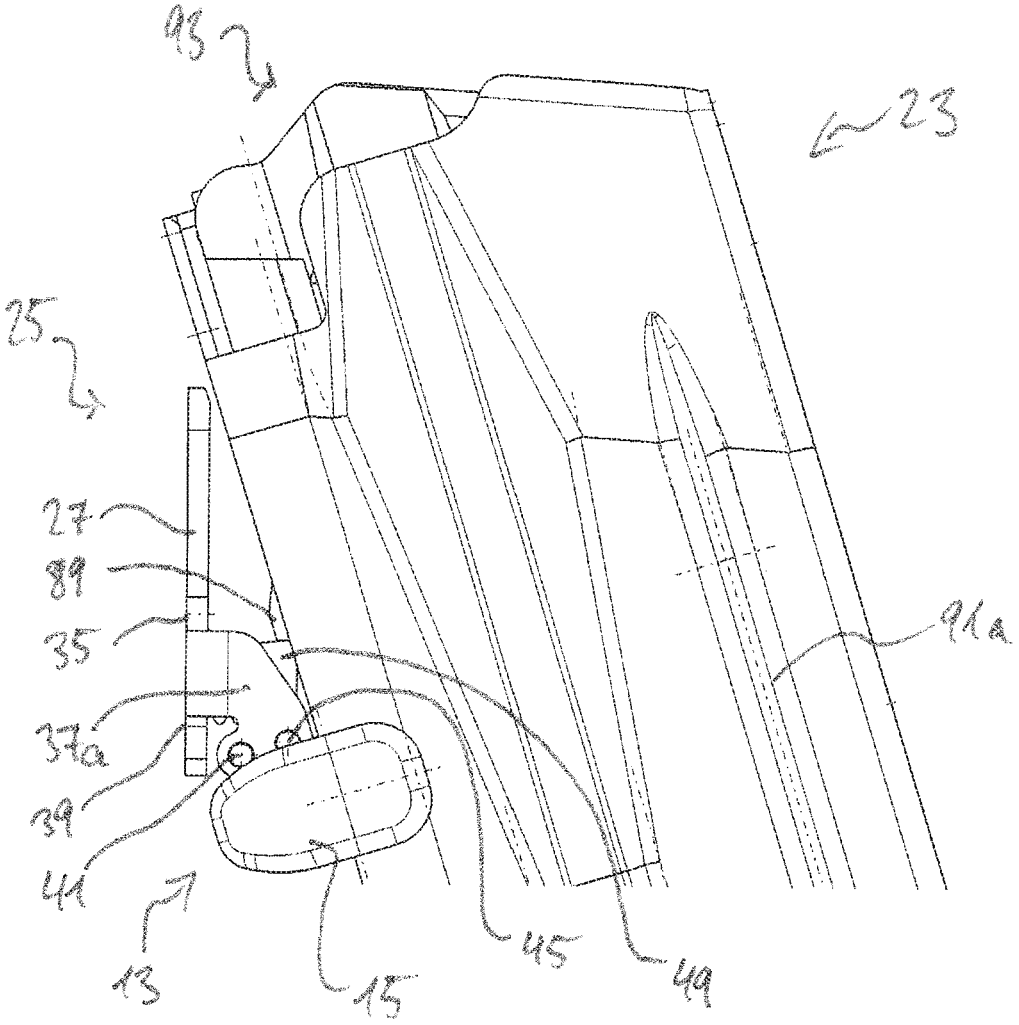
FIG. 2*a* is a perspective lateral view of the magazine release and holding apparatus of FIGS. 1*a*-1*b* in a magazine holding position.
Figure 2B:
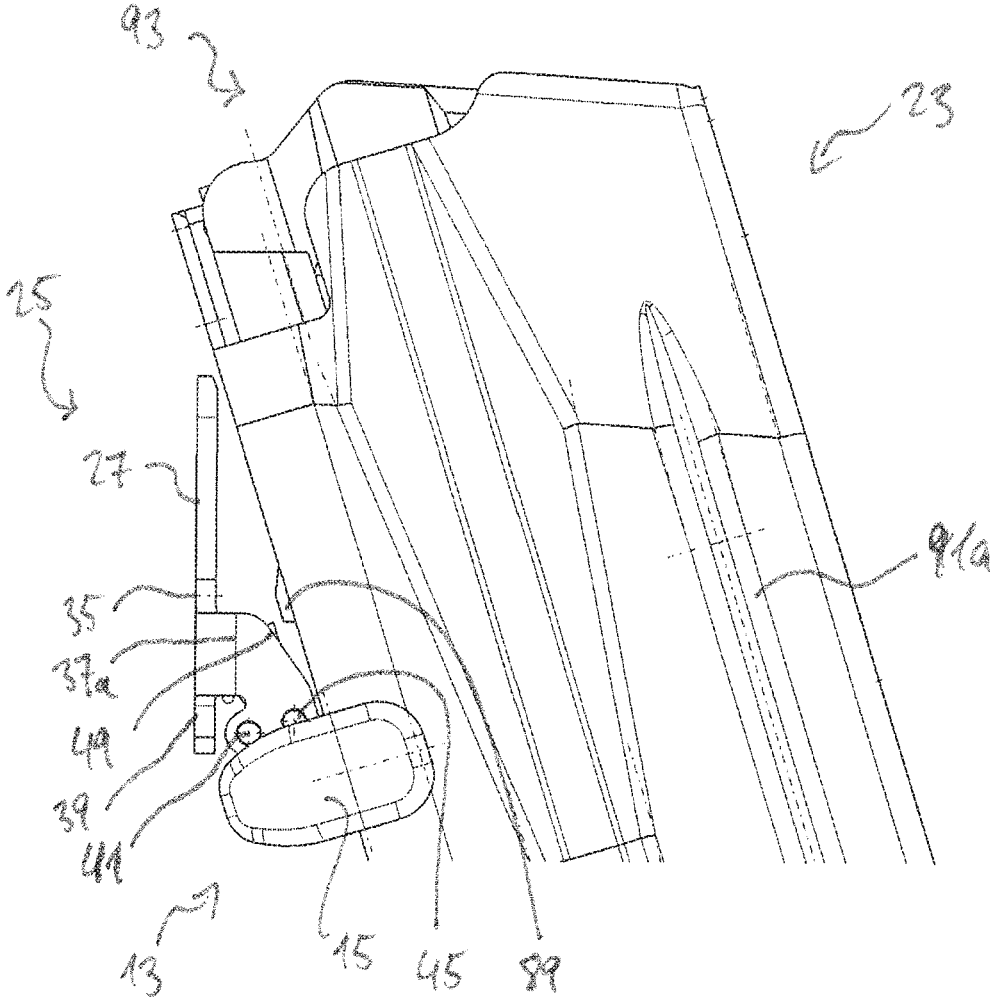
FIG. 2*b* is a perspective lateral view of the magazine release and holding apparatus of FIGS. 1*a*-1*b* in a magazine release position.

FIG. 2*a* shows the inventive magazine release and holding apparatus 1 in the magazine holding position, and FIG. 2*b* shows it with deflected magazine holding housing 25 in magazine release position. The magazine release and holding apparatus 1 essentially consists of two elements, the magazine release slide 13 (see FIG. 4) and a magazine holding housing 25 (see FIG. 3).

The front of the magazine 23 has a retaining projection 89 (e.g., a stop, a retaining catch) in the center for engaging with the magazine holding housing 25. In addition, lateral guide sections 91 (beads) are provided in the magazine 23 for supporting the inner cartridge column. At its upper end, the magazine 23 partly comprises in well-known manner a front, partly lateral recess for cartridge delivery/reception 93.

Figure 3:
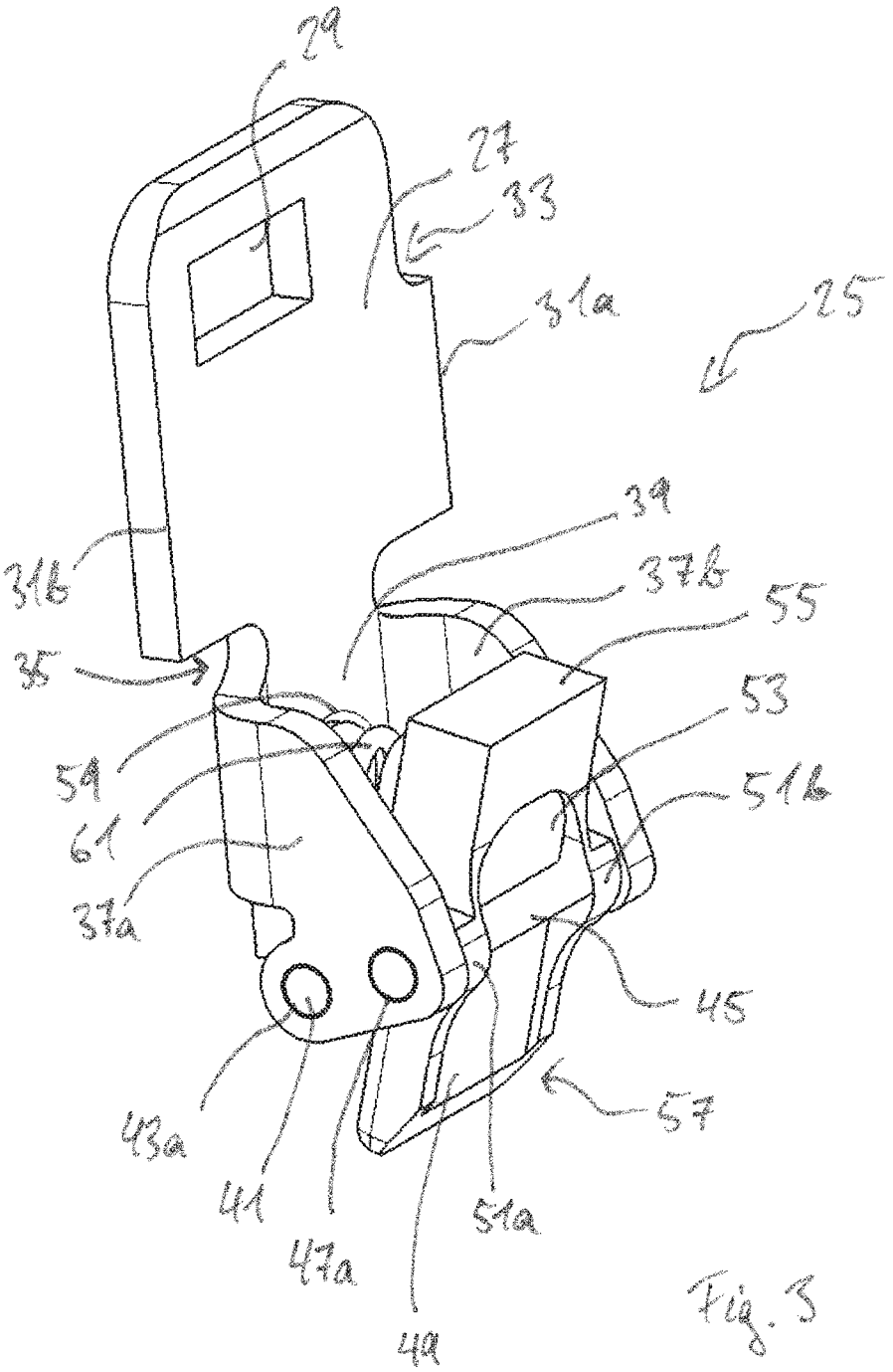
FIG. 3 is an enlarged perspective view from the rear left of an example magazine holding housing.

FIG. 3 shows an enlarged detailed perspective view of the magazine holding housing 25, which comprises a retaining plate 27 (e.g., an upper retaining plate), which is essentially square to rectangular and has rounded edges on its upper side. Approximately in the upper third of the retaining plate 27, an approximately rectangular catch recess 29 is provided, which can also have other suitable geometries. The longitudinal edges on both sides of the retaining plate 27 are provided as lateral guide sections 31*a, b*, which are provided for use in complementary guide recesses 107*a, b* (e.g., guides, guide sections) in the inside of the front inner wall 95 in the magazine shaft 22 of the handle piece 3 (see FIGS. 5 to 10). On the upper right-hand side, the lateral guide section 31*a* merges into a recess 33, which is intended in particular for space optimization.

At its underside, the retaining plate 27 opens into an approximately U-shaped constriction or notch 35 on both sides, which merges into a U-shaped cross-sectional arrangement, which extends backwards in a V-shaped, transformed or bent side flanks 37*a, b*, when viewed from the side. A rear wall 39 (e.g., a rear panel) connecting the two side flanks 37*a, b* extends the retaining plate 27 downwards. In the side flanks 37*a, b*, a stop bolt 41 is mounted in bearings 43*a* on both sides, (b is not shown), close to the rear wall 39. At the rear end of the side flanks 37*a, b*, facing the magazine, a bearing shaft 45 is accommodated in bearings 47*a*, (b is not shown) on both sides. A magazine holding rocker 49 (e.g., a rocker-type magazine holder) comprises integral eyelets 51*a, b* on its rear side, which surround the bearing shaft 45, so that the magazine holding rocker 49 is pivoted about the bearing shaft 45. The magazine holder 49 has a recess 53 on its underside, which is approximately U-shaped. By way of the removal of material from the recess 53, the legs of the magazine holding rocker 49 can be brought into balance so that the magazine holding rocker 49 does not tilt or oscillate under the influence of acceleration.

At its lower end, the magazine holder or magazine holding rocker 49 is tapered into an approximately wedge-shaped end section 57, which allows the magazine release slide 13 to be removed in the disassembling position of the magazine release and holding apparatus and secures the mounted magazine release slide 13 in the handle piece in the magazine holding and release position.

At its upper end, the magazine holding rocker 49 has a stop or a holding surface 55 for engaging the magazine holding rocker 49 with the stop projection or the retaining projection 89 on the magazine 23, which holds the magazine 23 in the magazine shaft 22 in the magazine holding position. A spring bearing 59 is provided between the two side flanks 37*a, b* approximately in the center of the rear wall 39 or extension of the retaining plate 27 to accommodate a compression spring 61, which pretensions the magazine holding rocker 49 into the magazine holding position.

In its rest position or magazine holding position, the magazine holding rocker 49 engages with the retaining projection or stop 89 of the magazine 23 (FIG. 2*a*) when the magazine is inserted over a holding surface 55 (e.g., a stop, a stop surface, an end). By pressing the push button 15 of the magazine release slide 13 in the direction of the firearm interior, the magazine holding rocker 49 can be adjusted, since the ramp section 77 lifts the lower wedge-shaped end section 57 of the magazine holding rocker 49 backwards in the direction of the shooter, until its upper end or holding surface 55 swivels forwards in the direction of the muzzle of the self-loading pistol and thereby disengages from the magazine retaining projection 89, so that the magazine 23 falls downwards out of the firearm or can be removed downwards.

The stop bolt 41 limits the maximum pivoting of the magazine holding rocker 49 and thus prevents the compression spring 61 from jumping out; the stop bolt 41 limits the expansion of the compression spring 61 and also the engagement of the stop surface 55 in the magazine shaft 22.

Figure 4A:
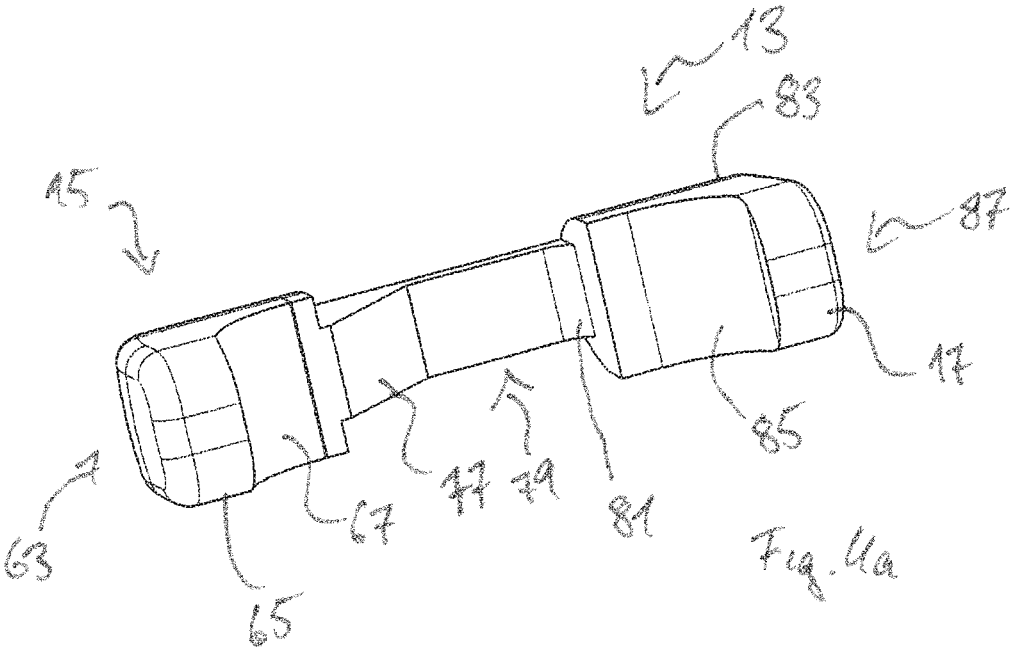
FIG. 4*a* is perspective view from the rear left of an example magazine release slide mounted to an example operating handle.
Figure 4B:
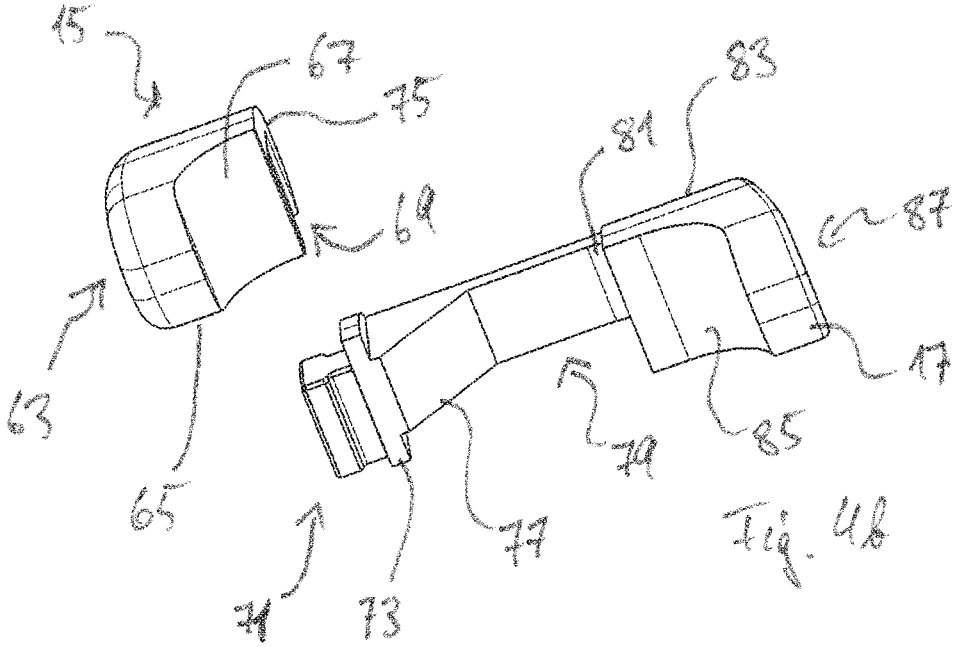
FIG. 4*b* is a perspective view from the rear left of the magazine release slide and the operating handle of FIG. 4*a* in a disassembled position.

FIG. 4*a* shows the magazine release slide 13 with assembled exchangeable operating handle or push button 15 and FIG. 4*b* with disassembled operating handle 15 or push button. The push button 15 has an approximately oval cross-section 63 and its outer peripheral surfaces are rounded inwards (see FIGS. 1*a*, 2*a* and 2*b*). An initially bale shaped section 65 merges at its inner rear side into a rounded taper 67, which is approximately complementary to the magazine 23, so as not to obstruct its insertion into the magazine shaft 22.

The interior of the push button 15 is partially cut out or provided with a guide recess 69 in the form of guide grooves, which are configured to complement the spring-like guide elements 71 on the left end of the magazine release slide 13. These guide elements 71 extend approximately perpendicular to the longitudinal direction of the magazine release slide 13 and have an approximately T-shaped cross-section, when viewed from above. The push button 15 can be simply pushed onto the magazine release slide 13 for assembly, wherein in the assembled state the push button 15 rests flush against the magazine release slide 13. For flush closure, the magazine release slide 13 has an approximately flange-like configuration at its end facing the push button 15.

A wedge-shaped ramp section 77 adjoins the flange 73, so that the cross-section of the magazine release slide 13 is tapered until it merges into a connecting section 79, which runs approximately rectangular and is approximately complementary to the magazine holding rocker 49. Toward the integral handle 17, the magazine release slide 13 is reinforced via a slightly wedge-shaped section 81 to its rear upper end and then merges into the integral handle 17. The handle 17 is configured to be approximately complementary to the push button 15. Toward the outside, it comprises an approximately oval cross-section 87 and a crowning section 83. The inner side facing the magazine 23 is also provided with an inwardly rounded taper 85, which is approximately complementary to the outer circumference of an edge of a magazine 23. The end pointing outward also has rounded peripheral surfaces.

The push button 15 can be provided in any suitable dimensions and can vary in both crowning and height to be adapted to the ergonomic characteristics of a shooter. With the replaceable push button 15 mounted through the plug connection, the shooter can adjust at user level the push button to his or her individual hand size. The push buttons 15 can be supplied with the pistol set in various lengths and geometries or sold as accessories. When the magazine release slide is assembled, the replaceable push button 15 is secured against unintentional disassembly or falling out or falling off by reaching around through the outer wall of the housing or handle piece 3.

Figure 8:
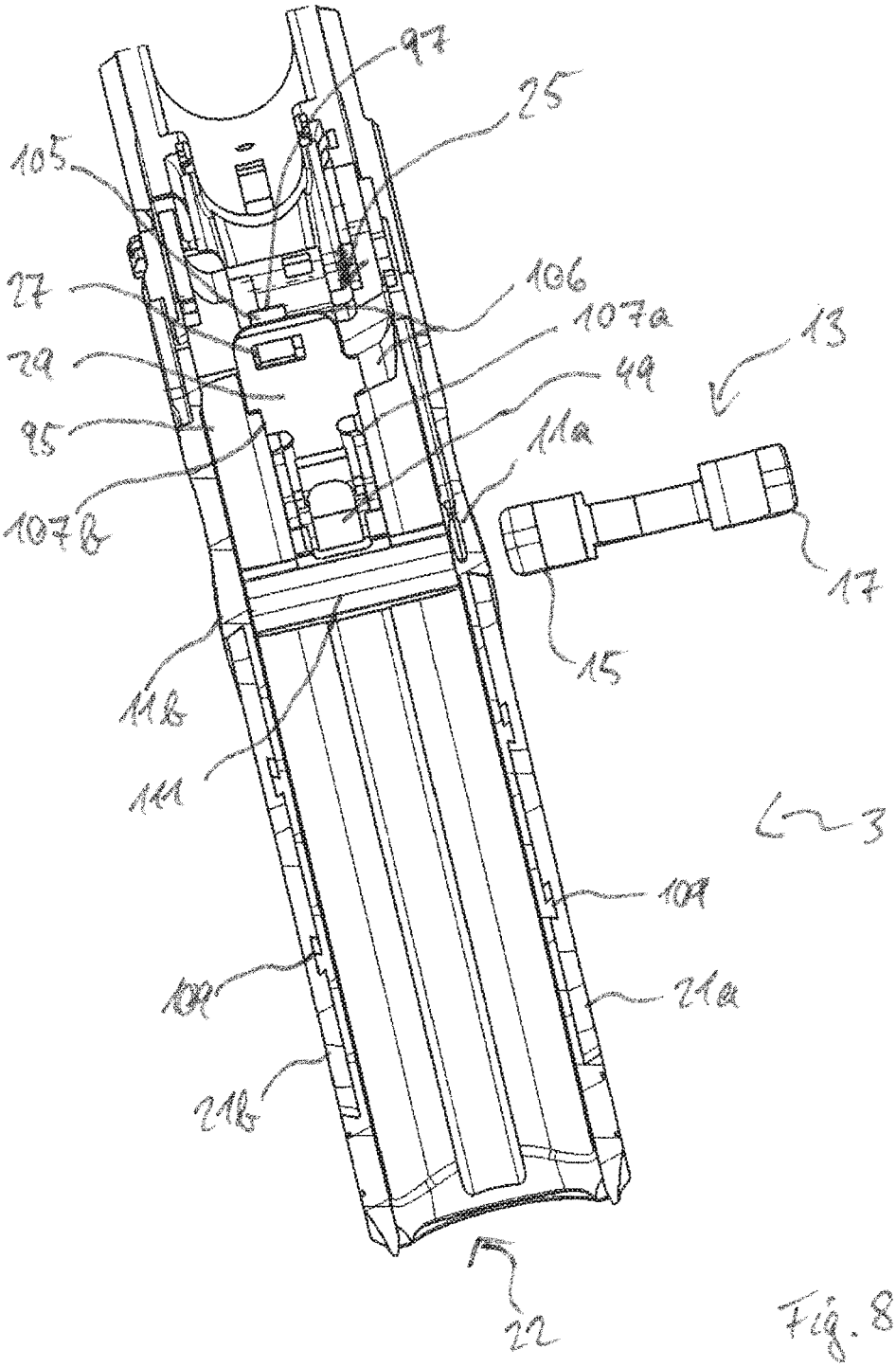
FIG. 8 is a partial cross-sectional perspective view of the handle piece of FIGS. 5-7 with the magazine release slide in a disassembled position for left-side operation.

FIGS. 5 to 8 show the inventive magazine release and holding apparatus 1 in assembled condition (FIG. 5), in disassembled/locking position (FIG. 6) and with removed magazine release slide 13 to be used for left-side operation (FIG. 7) or right-side operation (FIG. 8).

FIGS. 5 to 8 each show perspective partial cross-sectional views from the rear onto the front inner housing wall 95 of the magazine shaft 22. On the outside of the handle piece 3, replaceable handle shells 21*a, b* are inserted in dovetail guides 109 formed there. In its rest position, the magazine holding rocker 49 engages with the retaining projection or stop 89 of the magazine 23 when the magazine is inserted (see FIG. 2*a*). By pressing the push button 15 of the magazine release slide 13 in the direction of the interior of the firearm, the magazine holding rocker 49 can be adjusted, because the ramp section 77 lifts the lower wedge-shaped end section 57 of the magazine holding rocker 49 backwards in the direction of the shooter, until its upper end or stop end 55 swivels forwards in the direction of the muzzle of the self-loading pistol and thereby disengages from the magazine retaining projection 89, so that the magazine 23 falls down out of the firearm or can be removed downwards.

When the shooter now releases the magazine release slide 13, the magazine holding rocker 49, which is under pressure or tension of the compression spring 61, returns the magazine release slide 13 to its initial position, so that the stop 55 of the magazine holding rocker can engage again with a locking catch or stop projection or retaining projection 89 on the magazine 23, provided a magazine is inserted. In the magazine holding position, the magazine release slide 13 is located inside the handle piece 3, so that the magazine holding rocker 49 with its lower wedge-shaped end section 57 is again located approximately in the area of the rectangular complementary recess in the connecting section 79 and secures the magazine release slide 13 there or secures it against lateral removal.

When the magazine 23 is removed, the magazine holding rocker 49 with its lower wedge-shaped end section 57 rests against the stop bolt 41. When a magazine 23 is inserted into the magazine shaft 22, the inserted magazine 23 swivels the upper stop end or the holding surface 55 of the magazine holding rocker 49 forwards toward the retaining plate 27 until the magazine 23 is completely inserted into the magazine shaft 22 and the retaining projection has passed the holding rocker. In this position, the magazine holding rocker 49 with its upper stop surface 55 is then positioned behind the retaining projection or stop 89. The retaining plate 27 of the magazine holding housing 25 is in its lower locking position in which the catch recess 29 engages with the lower magazine holding catch 99. The magazine holding rocker 49 can now be actuated by operating the magazine release slide 13 and moved to the magazine release position.

A locking device in the form of a locking spring plate 97 is inserted/mounted in the inner wall 95 of the housing. Alternatively, the locking spring plate 97 can also have an integral configuration, for example, injection-molded. To prevent the locking spring plate 97 from breaking during rough handling, a stop is provided after a short bend.

Figure 5:
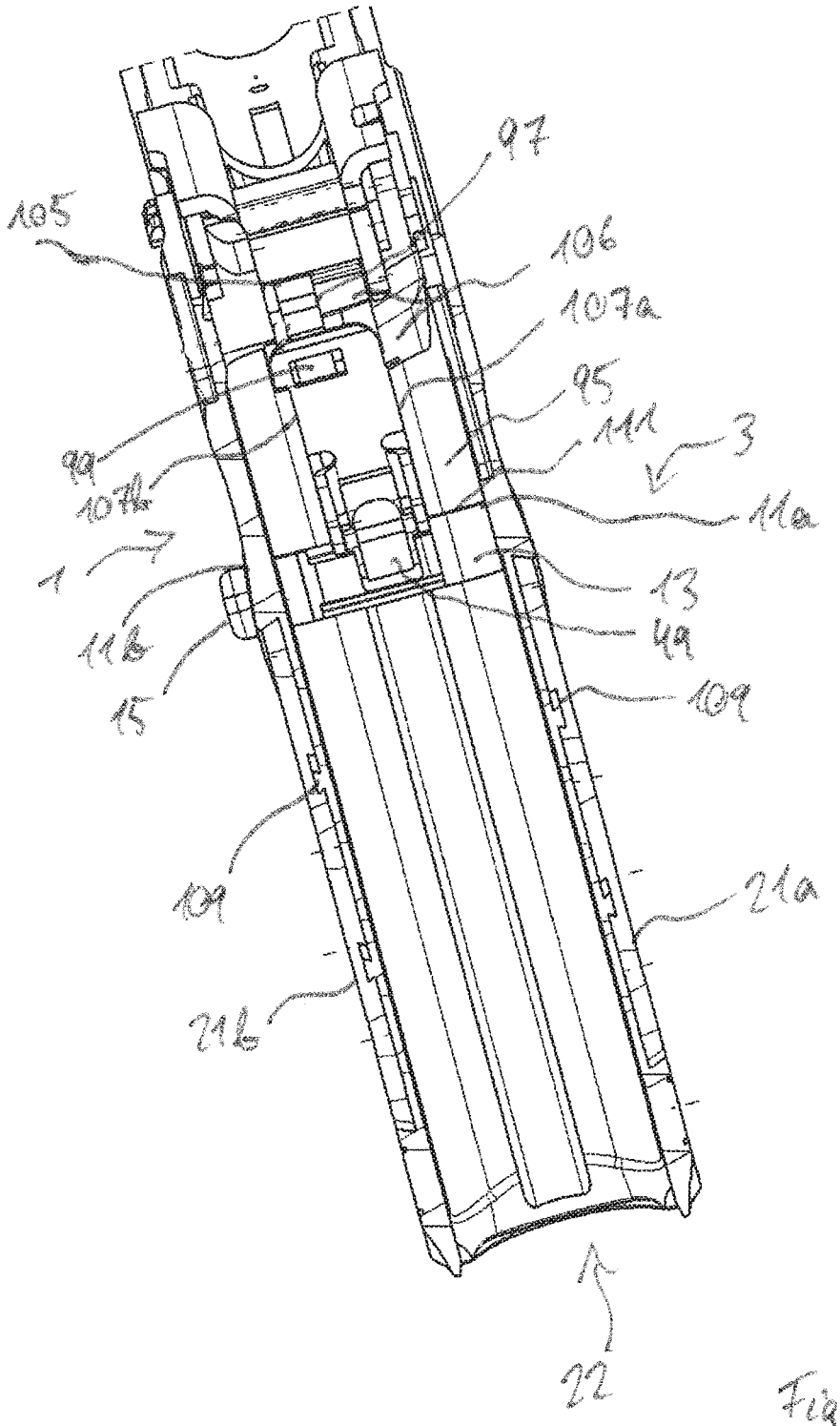
FIG. 5 is a partial cross-sectional perspective view from behind of the handle piece mounted to the magazine release and holding apparatus of FIGS. 1*a*-1*b*.

The locking spring plate 97 comprises a lower magazine holding catch 99 (e.g., a locking catch) with a lower stop 101 and is intended to engage in the catch recess 29 in the retaining plate 27 (see FIG. 5). In this locking position, the lower end section of the magazine holding rocker 49 fixes the mounted magazine release slide 13 on the housing or handle piece 3. When the push button 15 is not actuated, the magazine holding rocker 49 is positioned in the rectangular recess of the connecting section 79 between the ramp section 77 and the wedge-shaped reinforcement section 81.

Furthermore, the locking spring plate 97 comprises an upper magazine holding catch 103 (e.g., a locking catch) and an adjacent upper stop 105. The upper locking catch 103 also has the purpose of engaging with the catch recess 29 on the retaining plate 27 of the magazine holding housing 25 (see FIG. 6). To move the magazine holding housing 25 into its disassembly position, a user or shooter places from above a pin or screwdriver on the retaining plate 27 or between retaining plate 27 and locking spring plate 97, lifts the catch recess 29 out of the lower magazine holding catch or locking catch 99, moves the magazine holding housing 25 upwards until the catch recess 29 rests against the upper stop 105 and the recess 29 engages with the upper magazine holding catch 103 (see FIGS. 6 to 8). To prevent damage to the locking spring plate 97, it is located close to the locking block 106.

When moving the magazine holding housing 25 upwards, it is guided via its lateral guide sections 31*a, b* in complementary lateral longitudinal guide sections 107*a, b* in the front inner wall 95 in the magazine shaft 22 of the handle piece 3. In the upper locking position of the magazine holding housing 25 shown in FIGS. 6 to 8, the magazine release slide 13 can now be removed on both sides and can then be used optionally for left-hand or right-hand operation of a right-hand or left-hand shooter and/or a longer, higher or slimmer push button 15 of a different size can be attached. This measure allows a quick adjustment of the self-loading pistol for a right-hand or left-hand shooter and his/her special ergonomic characteristics.

Figure 6:
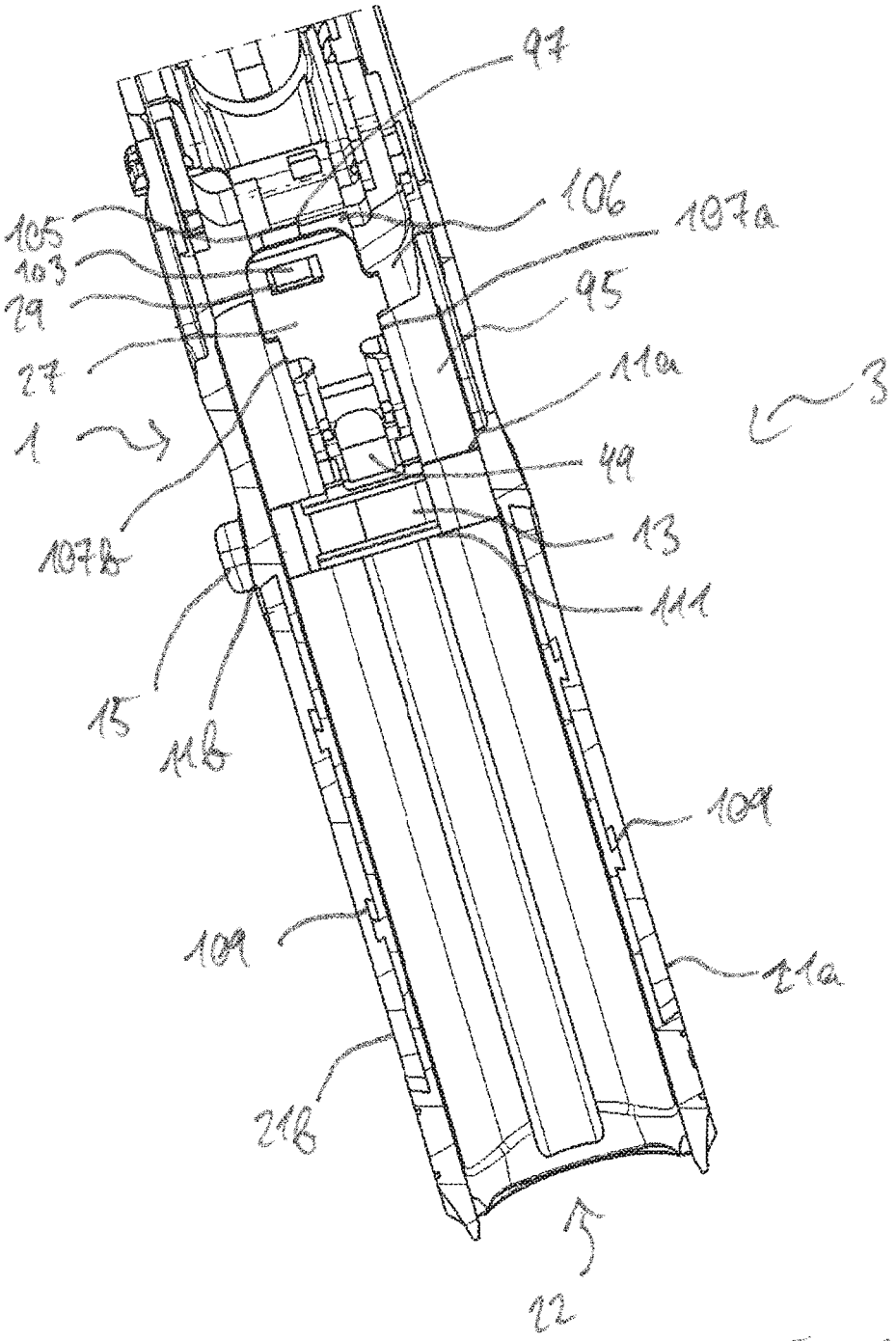
FIG. 6 is a partial cross-sectional perspective view of the handle piece and magazine release and holding apparatus of FIG. 5 in a disassembled position with the magazine release slide of FIGS. 4*a*-4*b* inserted.
Figure 7:
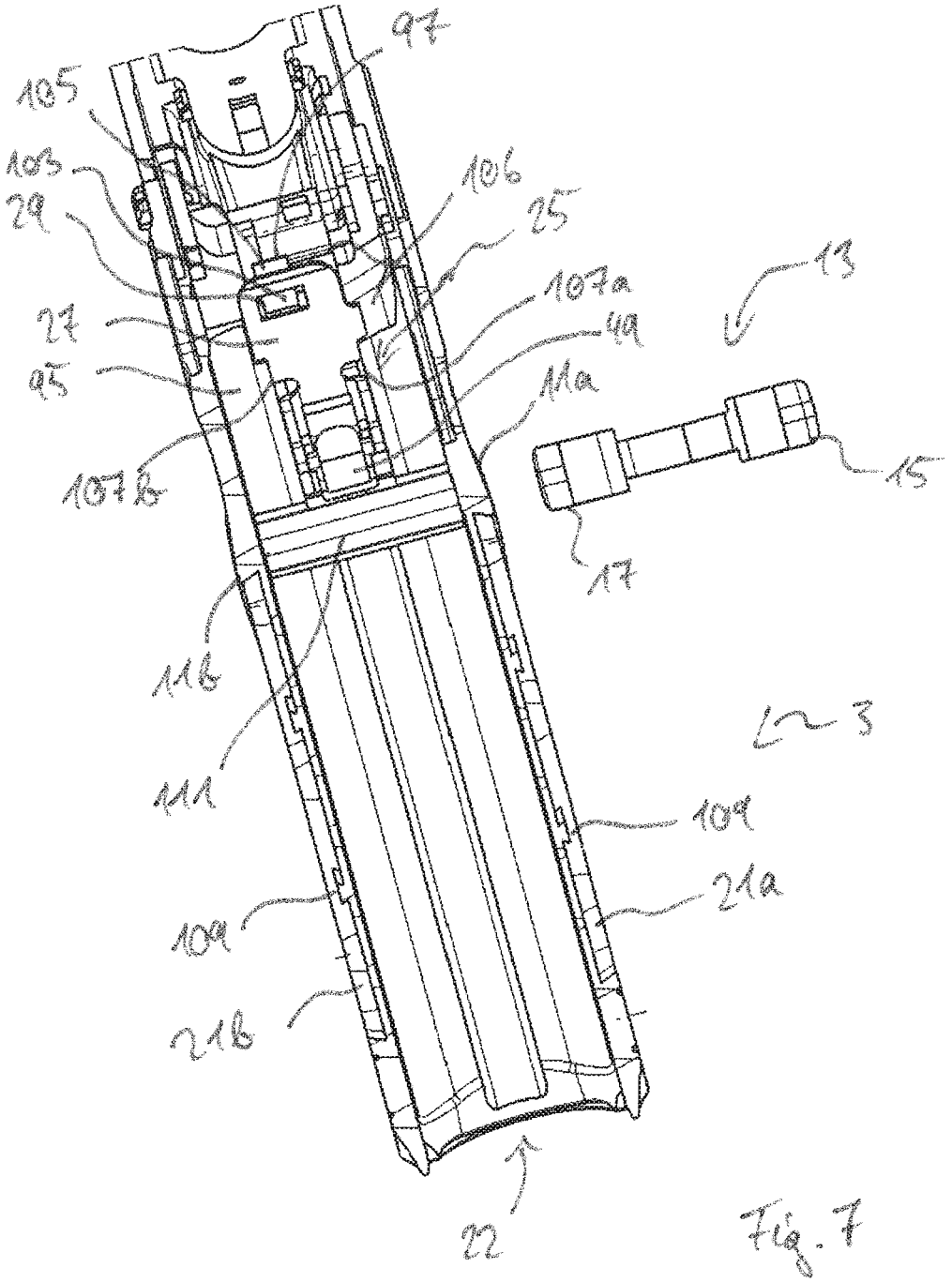
FIG. 7 is a partial cross-sectional perspective view of the handle piece of FIGS. 5-6 with the magazine release slide in a disassembled position for right-side operation.

After using the magazine release slide 13, it is fixed via the magazine holding rocker 49 in reverse order by releasing the locking position shown in FIG. 6 and moving the magazine holding housing 25 downwards to its lower locking position at which the lower magazine holding catch 99 engages again with the catch recess 29.

Figure 9:
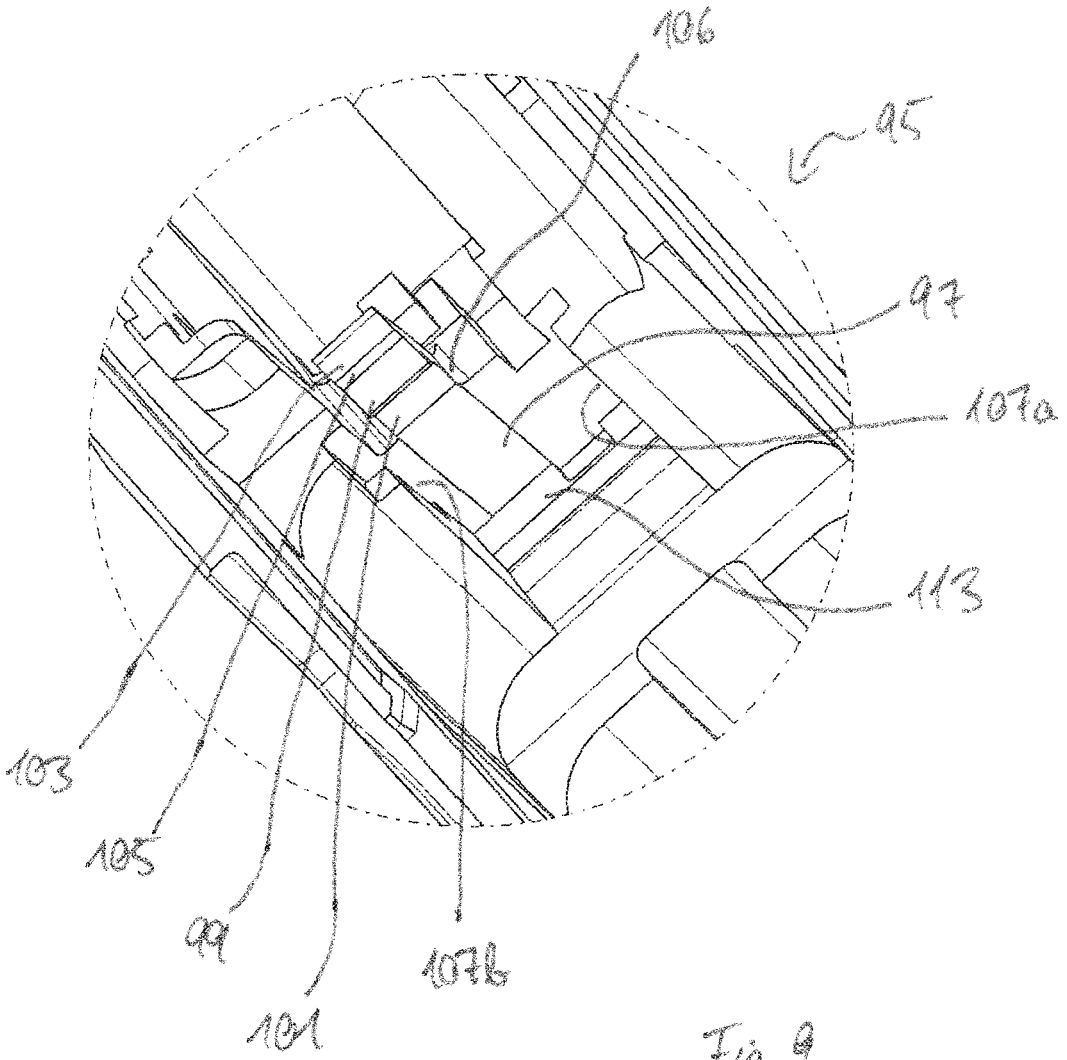
FIG. 9 is a partially cut-out perspective view from the top rear of the handle piece of FIGS. 5-8.
Figure 10:
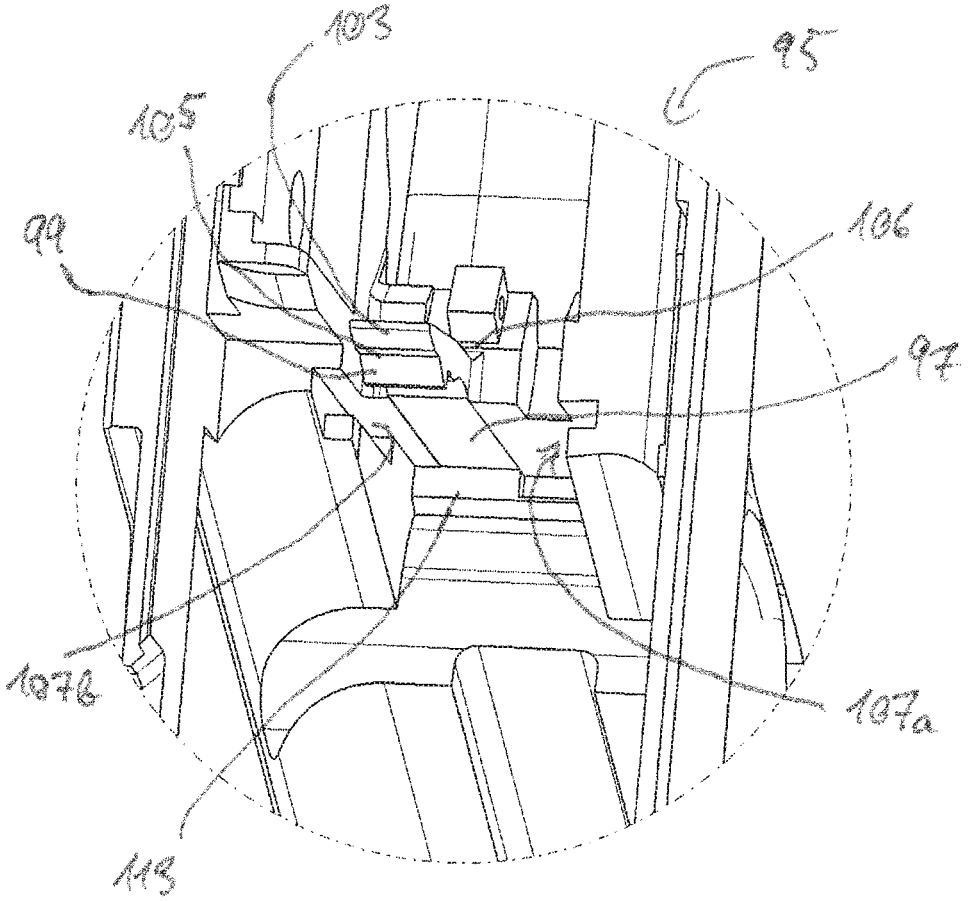
FIG. 10 is a partially cut-out perspective view from the rear top right of the handle piece of FIG. 9.

FIGS. 9 and 10 show various detailed perspective views of the locking spring plate 97, the lower magazine holding catch 99 and the upper magazine holding catch 103. In the background, the locking block 106 is partially shown in the handle piece. The two longitudinal guides 107*a, b* for guiding the retaining plate 27 of the magazine holding housing 25 are limited at their lower end by means of a stop 113.

It is noted that this patent claims priority from DE Patent Application Serial Number 10 2017 007 199.3, which was filed on Jul. 28, 2017, and is hereby incorporated by reference in its entirety.

Further embodiments of this disclosure are disclosed to an expert in the context of the following claims and enclosed figures. Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A magazine release and holding apparatus for a firearm, comprising:

a magazine release slide to transfer a magazine holding element between a holding position and a release position, an end of the magazine release slide including one or more guide elements extending perpendicular to a longitudinal direction of the magazine release slide, the one or more guide elements comprising a neck portion having a first dimension and a head portion having a second dimension different than the first dimension; and an operating handle including one or more counter guide recesses sized to receive the one or more guide elements and couple the operating handle to the magazine release slide, the one or more counter guide recesses comprising a neck recess sized to receive the neck portion and a head recess sized to receive the head portion, the operating handle projecting from a side of a handle piece of the firearm, wherein the operating handle is exchangeable and mountable to the magazine release slide by coupling or decoupling the operating handle and the magazine release slide.

2. The magazine release and holding apparatus of claim 1, wherein the one or more guide elements guide the one or more counter guide recesses during assembly and disassembly of the magazine release and holding apparatus.

3. The magazine release and holding apparatus of claim 1, wherein the handle piece secures the operating handle in a mounted position.

4. The magazine release and holding apparatus of claim 1, wherein the magazine release slide is dimensioned to enable the operating handle to be mountable and operable in a left-hand orientation or a right-hand orientation.

5. The magazine release and holding apparatus of claim 1, wherein the magazine release slide includes at least one recessed connection cutout to receive at least a portion of the magazine holding element in the holding position.

6. The magazine release and holding apparatus of claim 1, wherein the magazine release slide includes at least one ramped actuating section to translate the magazine holding element between the holding position and the release position when the magazine release slide is coupled to the operating handle.

7. The magazine release and holding apparatus of claim 1, further including a magazine holding housing to pivot the magazine holding element about a bearing shaft between the holding position and the release position.

8. The magazine release and holding apparatus of claim 7, wherein the magazine holding housing includes at least one stop element to limit a movement path of the magazine holding element.

9. The magazine release and holding apparatus of claim 7, wherein the magazine holding housing includes at least one holding section, the at least one holding section including guide sections to assemble or disassemble the magazine holding housing in the handle piece.

10. The magazine release and holding apparatus of claim 9, wherein the holding section includes at least one recess, and wherein an elastic securing element couples the at least one recess to an inner wall of the handle piece.

11. The magazine release and holding apparatus of claim 1, wherein the magazine holding element includes a first end section and a second end section, wherein one of the first end section and the second end section includes a counter-stop surface to engage with a stop of a magazine, and wherein the other of the first end section and the second end section secures the magazine release slide in the handle piece in the holding position or the release position.

12. The magazine release and holding apparatus of claim 1, wherein the magazine holding element pretensioned in the holding position by a compression spring.

13. A handle piece of a firearm, comprising:

a magazine release slide to transfer a magazine holding element between a holding position and a release position, an end of the magazine release slide including a first guide element extending parallel to a longitudinal direction of the magazine release slide and a second guide element extending perpendicular to the longitudinal direction of the magazine release slide; and an operating handle including one or more counter guide recesses sized to receive the first and second guide elements and couple the operating handle to the magazine release slide, the operating handle projecting from a side of the handle piece of the firearm, wherein the operating handle is exchangeable and mountable to the magazine release slide by coupling or decoupling the operating handle and the magazine release slide.

14. The handle piece of claim 13, wherein at least one of a first side and a second side opposite the first side of the handle piece further includes at least one recess to assemble or disassemble the magazine release slide.

15. The handle piece of claim 13 further including a magazine shaft, wherein a front inner side of the magazine shaft includes an elastic safety element to couple with a recess of a holding element of a magazine holding housing.

16. The handle piece of claim 15, wherein the elastic safety element includes at least one of a locking catch or a stop to secure the holding element in the handle piece.

17. The handle piece of claim 15, wherein the front inner side of the magazine shaft includes at least one guide to receive and guide at least one complementary counter guide section of the holding element.

18. A firearm housing of a firearm, comprising:

a magazine release slide to transfer a magazine holding element between a holding position and a release position, an end of the magazine release slide including one or more non-circular guide elements extending perpendicular to a longitudinal direction of the magazine release slide; and an operating handle including one or more non-circular counter guide recesses sized to receive the one or more non-circular guide elements and couple the operating handle to the magazine release slide, the operating handle projecting from a side of a handle piece of the firearm, wherein the operating handle is exchangeable and mountable to the magazine release slide by coupling or decoupling the operating handle and the magazine release slide.

19. A magazine of a firearm, comprising:

a magazine release and holding apparatus, comprising:

a magazine release slide to transfer a magazine holding element between a holding position and a release position, an end of the magazine release slide including a ramped section that tapers from one or more guide elements, the one or more guide elements extending perpendicular to a longitudinal direction of the magazine release slide; and an operating handle including one or more counter guide recesses sized to receive the one or more guide elements and couple the operating handle to the magazine release slide, the operating handle projecting from a side of a handle piece of the firearm, wherein the operating handle is exchangeable and mountable to the magazine release slide by coupling or decoupling the operating handle and the magazine release slide; and a stop on a front side of the magazine to engage the magazine holding element of the magazine release and holding apparatus.

* * * * *